United States Patent [19]

Patton

[11] 3,986,591

[45] Oct. 19, 1976

[54] VEHICLE ACTUATED PARKING DEVICE

[76] Inventor: Samuel E. Patton, 344 King George Ave., Roanoke, Va. 24016

[22] Filed: Jan. 26, 1976

[21] Appl. No.: 652,328

Related U.S. Application Data

[63] Continuation-in-part of Ser. No. 555,091, March 4, 1975, Pat. No. 3,948,378.

[52] U.S. Cl. ..... 194/1 R

[51] Int. Cl.[2] ..... G07F 17/24

[58] Field of Search ..... 194/DIG. 21, DIG. 22, 194/DIG. 23, 1 R

[56] References Cited

UNITED STATES PATENTS

| | | | |
|---|---|---|---|
| 2,627,920 | 2/1953 | Barlow | 194/DIG. 22 |
| 2,883,780 | 4/1959 | Goodman | 194/DIG. 22 |

*Primary Examiner*—Stanley H. Tollberg
*Attorney, Agent, or Firm*—Stevens, Davis, Miller & Mosher

[57] ABSTRACT

A parking device is disclosed which includes a substantially horizontally extending elongated arm for engaging the underpanel of a vehicle parked in the parking area. The arm is pivotally connected to the lower end of a post on which the parking meter is mounted. The elongated arm is above the surface of the parking area and is movable between a position in which it may engage the underpanel of a parked vehicle and prevent removal of the vehicle from parking position adjacent the post and another position in which the arm will not engage the underpanel of a vehicle parked therein so that the vehicle may be moved into and out of parking position adjacent the post. A bumper, actuated by a vehicle to be parked, is mounted on an intermediate portion of the post. Structure, which includes the bumper, simultaneously actuates the parking meter and moves the arm into the position in which it may engage the underpanel of a vehicle parked adjacent the post. Upon returning to his vehicle, the operator thereof need only insert a sufficient monetary amount in the parking meter whereupon the parking meter will deactuate the structure so that the arm thereby moves from its position in which it may engage the underpanel of the parked vehicle to its position in which it will not engage the underpanel so the parked vehicle may be removed from parking position adjacent the post.

21 Claims, 15 Drawing Figures

FIG. 1
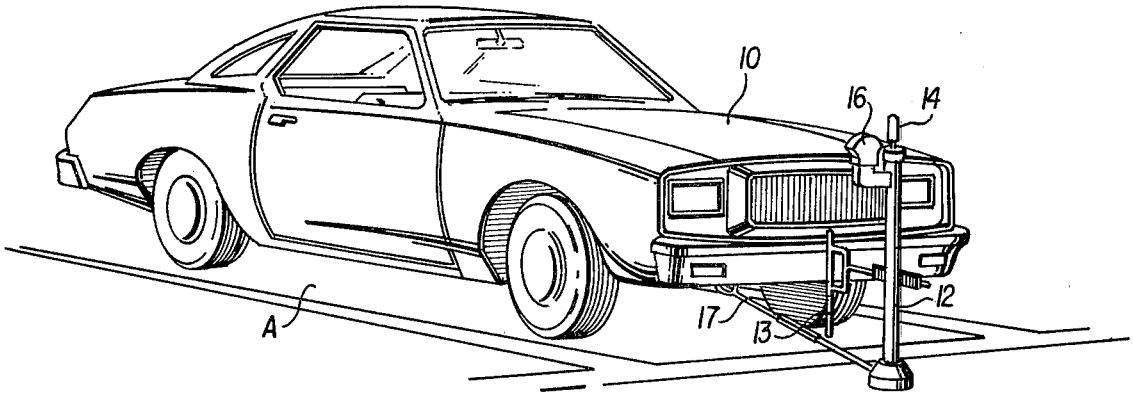
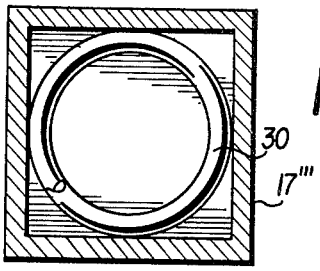
FIG. 10
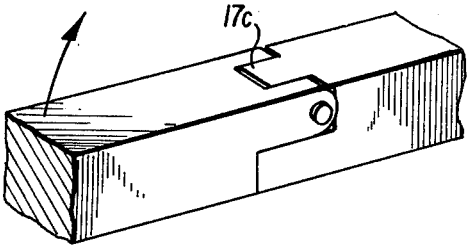
FIG. 9
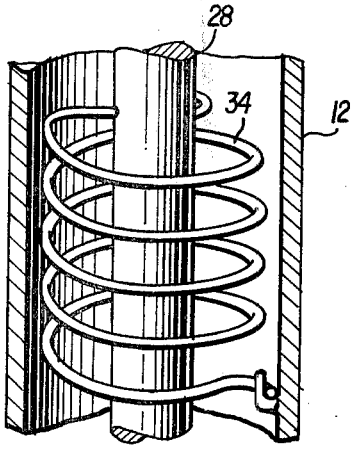
FIG. 7

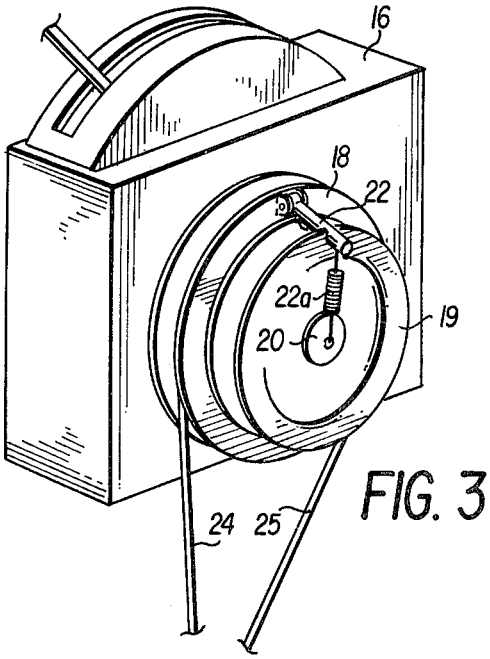
FIG. 3
FIG. 4A
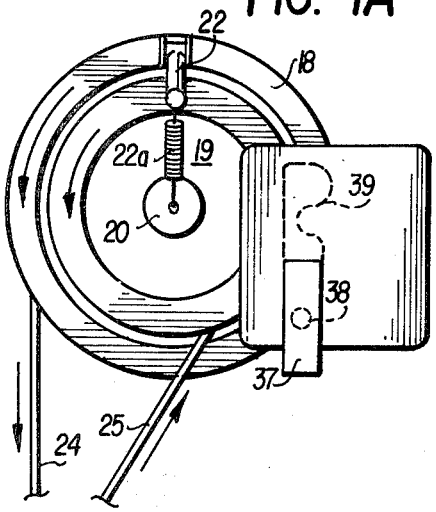
FIG. 4B
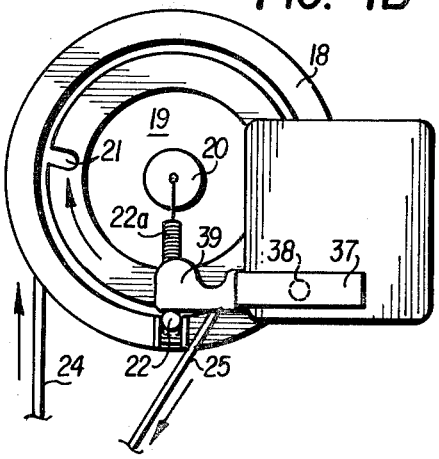
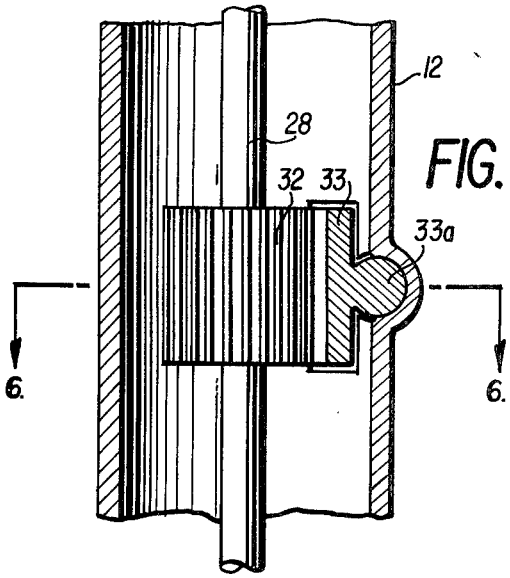
FIG. 5
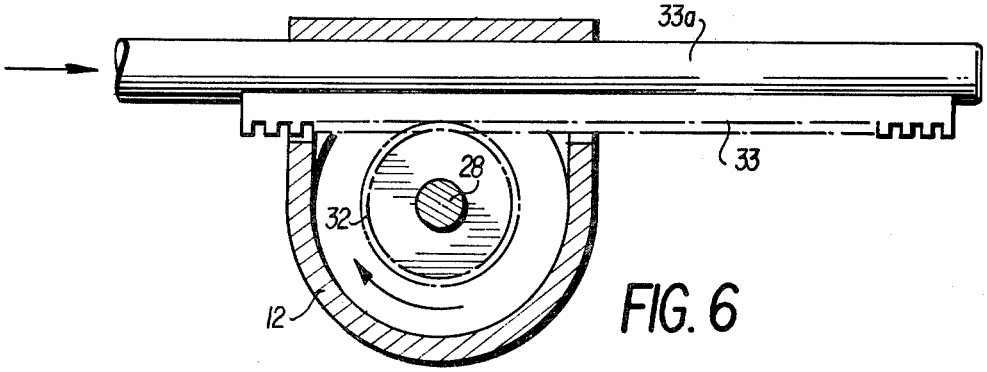
FIG. 6

VEHICLE ACTUATED PARKING DEVICE

CROSS REFERENCE TO RELATED APPLICATIONS

This application is a continuation-in-part of applicant's copending U.S. patent application Ser. No. 555,091 filed Mar. 4, 1975, now U.S. Pat. No. 3,948,378.

BACKGROUND OF THE INVENTION

1. Field of the Invention

This invention relates to a parking device for motor vehicles. More specifically, the invention relates to a parking device which is automatically actuated by the movement of the vehicle into parking position adjacent a post and is automatically deactuated by the insertion of a sufficient monetary amount in the parking meter and the removal of the parked vehicle from parking position adjacent the post.

2. Description of the Prior Art

Various types of parking systems have been proposed. One of the most commonly known systems provides a parking meter in which the operator or occupant of a parked vehicle merely inserts a sufficient monetary amount into the parking meter at the time he initially parks therein. The amount of money he inserts in the meter is generally in proportion to the amount of time he anticipates the vehicle will be parked. This type of parking system is undesirable because it requires the motorist to anticipate the time during which his vehicle will remain parked. As a result, if the motorist incorrectly anticipates the time interval between his initial parking of the automobile and its subsequent removal, and if motorist either neglects or forgets to deposit further monetary amount into the meter, it is possible that he will receive a parking violation. This type of parking system has a further disadvantage in that it requires police supervision for potential violations. This supervision is necessary to discourage what could otherwise be free parking. This police supervision is costly unnecessary.

A second type of parking system which is known utilizes a parking meter which is automatically operated, by movement of the vehicle into parked position in a parking area, to measure the length of time the vehicle remains parked therein. Upon returning to the vehicle, the motorist deposits a sufficient monetary amount into the parking meter before removing the vehicle from the parking area. To assure payment of the proper amount corresponding to the parking period, this second type of parking system generally includes some form of barrier which is positioned behind one or both of the front wheels of a parked vehicle to prevent its removal from the parking area until such time as the sufficient monetary amount has been inserted in the parking meter. These barriers are positioned in, on, or directly adjacent the surface of the parking area. Examples of this second type of parking system are shown in U.S. Pat. No. 2,805,498 to R. E. Mosher, et al., U.S. Pat. No. 3,503,480 to C. L. Selby, Jr., and U.S. Pat. No. 3,757,916 to C. L. Selby.

With the second type of system described above, since the vehicle is automatically blocked in the parking area and cannot be removed therefrom except by the insertion of a sufficient monetary amount in the parking meter, collection of the parking fee is assured and a supervisory attendant for the parking area is not required. This second type of parking system is satisfactory for both street curb parking and for off-street parking in lots and garages. Because this type of parking system is self-enforcing, less personnel are required to operate the parking system than are required for conventional parking lots and garages and, except for clean-up and maintenance, such personnel are not required at all.

As the barriers used in this second type of parking system are positioned in, on, or directly adjacent to the surface of the parking area, the surface cannot easily be cleaned by conventional cleaning equipment because the barriers which in some instances project above the surface of the parking area, may interfere with the cleaning equipment. As a result of this interference, the cleaning equipment and/or the parking system may be damaged. Furthermore, it is not possible to plow the surface of the parking area to remove snow or ice therefrom when the barriers project from the surfaces because again such an operation could result in damage to the plows and/or the parking systems because of interference between the plows and the projecting barriers.

One further disadvantage of the above-described second type of parking system, for example that shown in the abovedescribed U.S. Pat. No. 3,503,480, is that a substantial portion of the apparatus of the parking system must be placed in the surface of the parking area so that a substantial amount of time and labor must be expended in installing such a system in a new parking facility or in adapting such a system to an existing parking facility.

SUMMARY OF THE INVENTION

This invention relates to a parking device which is similar to the second type of system described above.

The invention includes a parking meter mounted on the upper end of a post and an arm, above the surface of the parking area, pivotally connected to the lower end portion of the post. The arm extends substantially horizontally and is movable between a first position in which it may engage the underpanel of a vehicle parked therein so that the vehicle may be moved into and out of parking position adjacent the post.

The arm may include a first substantially horizontally extending arm portion pivotally connected at one end thereof to the post and a plurality of substantially vertically extending short finger portions extending upwardly from the other end of the arm portion. The arm portion may also include a joint adjacent the end thereof about which the part of the arm, from the joint out to and including the fingers portions, is upwardly pivotable. As a result of this possible upward pivotable movement, if a snow plow or other surface cleaning equipment contacts the arm, the outermost portion thereof can freely pivot upwardly to thereby prevent damage to the arm and its connection to the post. Also, the arm may be formed into first, second, and third sections. The third section may be hollow, have a spring disposed therein, and telescopically receive an end of each of the first and second sections. As a result, if the second arm section is struck by a plow or other surface cleaning equipment or a vehicle moving into parking position adjacent the post, the second arm section can move relative to and toward the first arm section to thereby prevent damage to the plow or other cleaning equipment, the arm and its connection to the post. Likewise, if a vehicle moving into parking position adjacent the post strikes the arm it can move to prevent such damage and yet still ultimately prevent removal of the vehicle from parking position until such time as the parking meter has been satisfied.

The invention further includes vehicle actuable means, which includes a bumper, connected to an intermediate portion of the post, adapted to be contacted and moved by a bumper of the vehicle, which, when activated by a vehicle to be parked, actuates the parking meter so that the parking time begins to run. Actuation also simultaneously moves the arm from its position in which it will not engage the underpanel of a vehicle to the position in which it may engage the underpanel of a parked vehicle and prevent removal thereof from parking position adjacent the post. With the time running, the motorist may then leave his vehicle parked for any amount of time and does not have to be concerned about a parking violation.

The vehicle actuable means may also include a first pulley mounted on a shaft on the parking meter, a second pulley on that shaft releasably interconnected to the first pulley, a substantially vertically extending shaft rotatably mounted within the post, and a third pulley fixedly mounted on the upper end portion of the substantially vertically extending shaft.

The means actuable by the vehicle may further include two elongated flexible substantially inextensible cables. The first cable has one end connected to the first pulley and the other end connected to the third pulley. The second cable has one end connected to the second pulley and the other end connected to the arm so that when the means, actuable by a vehicle moving into parking position adjacent the post is actuated, the actuator member is moved by the vehicle and the first cable connected to the actuator member is also moved which thereby moves the first pulley, and the second pulley releasably connected thereto, the second cable, and the arm. The arm is thereby moved from its position in which it will not engage the underpanel of a vehicle parked adjacent the post so that the vehicle may be moved into or out of the parking area into its position in which it may engage the underpanel of a vehicle parked adjacent the post, and prevent removal thereof from parking position adjacent the post.

Alternatively, the first cable may be replaced by a rod connected at one end by a U-joint to the upper end of the substantially vertically extending shaft and pivotally connected to its other end to the first pulley or a disc or plate, instead of the first pulley, releasably interconnected to the second pulley.

The means actuated by the vehicle may further include a pinion rigidly mounted on the substantially vertically extending shaft, and a rack, rigidly connected to the bumper, in meshing engagement with the pinion or a fourth pulley rigidly mounted on the substantially vertically extending shaft, a bar rigidly connected to the bumper, and a third cable, one end portion of which is connected to the bar and the other end portion of which is connected to the fourth pulley. The invention may further include a return spring which is connected between the post and the substantially vertically extending shaft which is adapted to return the bumper to its unactuated position when a vehicle parked adjacent the post moves out of contact therewith.

Also in this invention, an indicator member is provided which is connected to the upper end of the substantially vertically extending shaft. The indicator member is movable between a first lower position and a second upper position which indicates to the operator of the vehicle to be parked that it is properly parked adjacent the post. To effect the elevating movement of the indicator member, the upper end of the substantially vertically extending shaft is threaded. The indicator member is non-rotatable and is mounted over the upper end of the second shaft. The indicator member includes a key which extends into the threads on the substantially vertically extending shaft so that when the bumper is moved by a vehicle moving into parking position adjacent the post, the rack moving therewith rotates the pinion, or the bar through the third cable rotates the fourth pulley, so that the substantially vertically extending shaft is rotated and the key moves upwardly along the threads in that shaft and elevates the indicator member from its first lower position to its second upper position indicating to the vehicle operator that the vehicle is properly parked adjacent the post.

Upon return to the vehicle, the motorist merely inserts the necessary monetary amount, which may correspond to the length of time the vehicle has been parked, in the parking meter. Upon the insertion of the necessary monetary amount in the parking meter, the parking meter deactuates the means actuated by the vehicle upon initial parking so that the arm thereby moves from its position in which it may engage the underpanel of a parked vehicle and prevent removal of a vehicle in the parking area to its position in which it will not engage the underpanel of a vehicle parked therein so that the parked vehicle may be removed from parking position adjacent the post.

Because the arm for engaging the underpanel of a parked vehicle and all other parts of this invention are spaced above the ground and because the arm may be pivotally connected to the post on which the parking meter is mounted, the parking device of this invention may be readily adapted to existing parking facilities or to new parking facilities without the expenditure of a substantial amount of time and labor because the device does not have to be placed in the ground. The parking device of this invention could be installed in a parking facility substantially as easily as a conventional parking meter mounted on a post.

From the foregoing, it is apparent that this invention has as one of its principal objects, the provision of a parking device which is automatically operated by the movement of the vehicle into parked position adjacent the post. This object is accomplished in part by the provision of means actuated by the vehicle which initiates timing of the parking meter and moves an arm into a position in which it may engage the underpanel of a parked vehicle and prevent removal of the vehicle from parking position adjacent the post.

A further object of this invention is to porvide a parking device which may be readily adapted to existing parking facilities or to new parking facilities without the expenditure of a substantial amount of time and labor.

A further object of this invention is to provide a parking device which does not have to be placed in the ground.

A further object of this invention is to provide a parking device having a vehicle underpanel engaging arm which can move freely when contacted by any equipment cleaning the parking area, snow plows, etc. to thereby further avoid possible interference between and damage to the parking device and/or the cleaning equipmeent, snow plows, etc.

A further object of this invention is to provide a superior parking device which is self-enforcing.

A further object of this invention is to provide a superior parking device in which a parked vehicle cannot be removed from the parking area until a sufficient monetary amount has been inserted into the parking meter.

A further object of this invention is to provide a superior parking device in which the vehicle occupant does not have to insert any money into the parking meter until he is ready to remove his vehicle from parking position adjacent the post.

A further object of this invention is to provide a superior parking device which indicates to the occupant of the vehicle that the vehicle is properly parked in parking position adjacent the post.

BRIEF DESCRIPTION OF THE DRAWINGS

FIG. 1 is a perspective view of the invention showing a vehicle parked in parking position;

FIG. 3 is a detailed perspective view of the parking meter and portion of the structure actuated by the vehicle;

FIG. 4A is an end view of a portion of the structure actuated by the vehicle in its unactuated position;

FIG. 4B is a view similar to FIG. 4A but showing the same in a position in which the parking meter has been satisfied by a sufficient monetary amount so that the structure actuated by the vehicle in returning to its unactuated position.

FIG. 5 is a detail, in side view and partly in section, of FIG. 2;

FIG. 6 is a sectional view along line 6—6 of FIG. 5;

FIG. 7 is an enlarged view of the return spring shown in FIG. 2;

FIG. 9 is a perspective view of a detail of the arm;

FIG. 10 is a view along line 10—10 of FIG. 2; and

DETAILED DESCRIPTION OF THE PREFERRED EMBODIMENTS

Figure 8A:
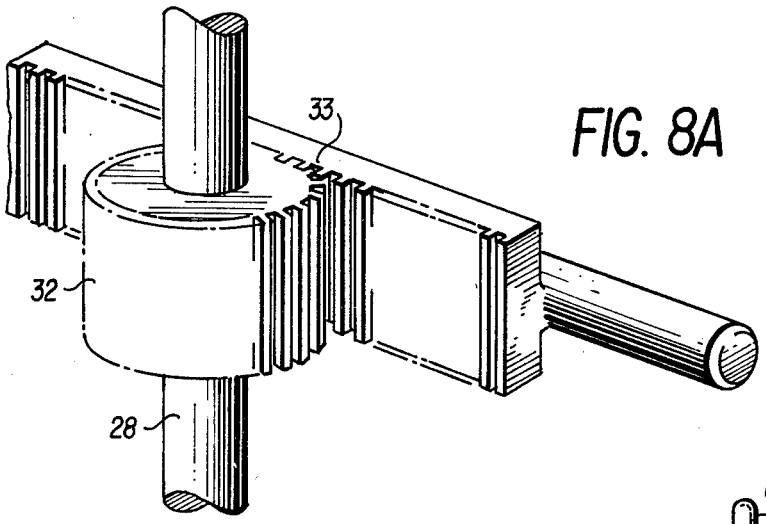
FIG. 8A is an enlarged view of the rack and pinion shown in FIG. 2.

With reference to FIG. 1, there is shown therein an automobile 10 parked in a parking area A. At one end of the parking area is positioned a post 12 which is mounted on and extends upwardly from the ground or surface of the parking area. A bumper 13 is connected to an intermediate portion of the post 12. The bumper 13 is adapted to be contacted and moved by the bumper of the vehicle to be parked in a manner to be subsequently described. On the upper end of the post 12 is an indicator member 14 which, as shown in its uppermost position in FIG. 1, indicates to the occupant of the vehicle 10 that the vehicle is properly parked adjacent the post. A parking meter 16 is also positioned on the upper end of the post 15. An arm 17 is pivotally connected to the lower end portion of the post 12. The arm 17 is movable between an upper position in which it may engage the underpanel of a parked vehicle (FIG. 1) and a lower position in which it will not engage the underpanel so that a vehicle may be moved into and out of parking position adjacent the post.

As used in this invention, the term "underpanel"is intended to mean any portion of the underside of the vehicle such as the lower edges of the bumpers, the chassis, the axles, etc., i.e., any portion of the underside of the vehicle readily engagable by an arm such as the arm 17 described above and to be subsequently described in greater detail.

Figure 3A:
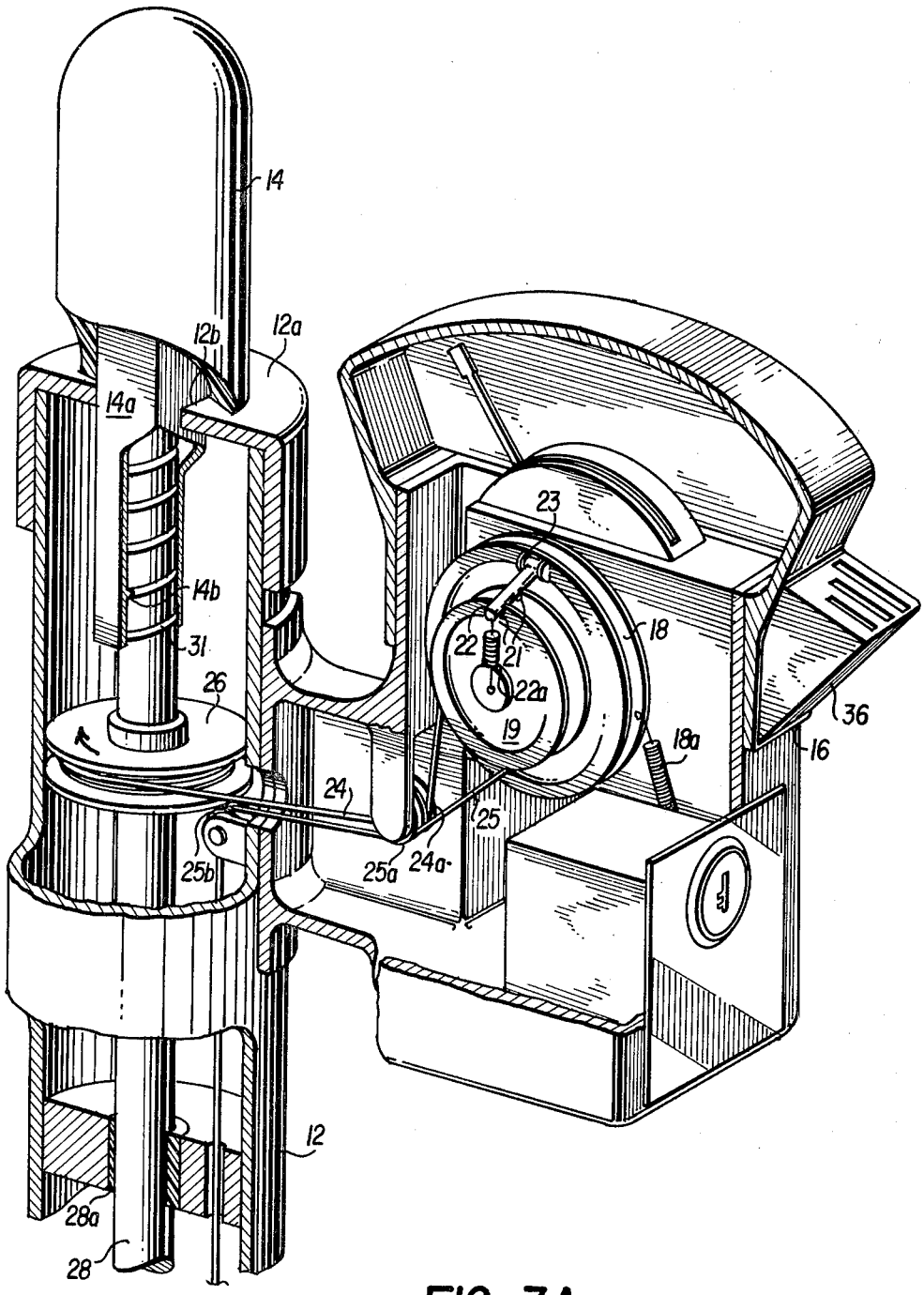
FIG. 3A is a detailed perspective view, partly in cross-section, of the parking meter, the upper end of the post, and the indicator member.

With reference to FIG. 3A, a first pulley 18 and a second pulley 19 are shown. The first pulley 18 and the second pulley 19 are releasably interconnected. Each of the pulleys 18 and 19 are freely rotatably mounted on a shaft 20 which extends from a portion of the parking meter 16. A return spring **18*a* is connected between the parking meter 16 and the periphery of the first pulley 18. The return spring 18*a* functions to return the pulley 18 to its initial position shown in FIG. 3A** upon deactuation of the parking device.

With particular reference again to FIG. 3A, the releasable interconnection between the pulleys 18 and 19 will be described. A notch 21 is cut in each of the annular flanges of the second pulley 19. Releasably positionable in the notch 21 is an elongated arm 22 pivotally connected at 23 to the periphery of the first pulley 18. A spring **22*a* has one end connected to an end of the arm 22 and its outer end connected to the end of the shaft 20. The spring 22*a* functions to hold the arm 22 in the notch 21 of the second pulley 19 so that the pulleys 18 and 19 are thereby releasably interconnected so as to be rotatable together about the axis of the shaft 20**.

Figure 2:
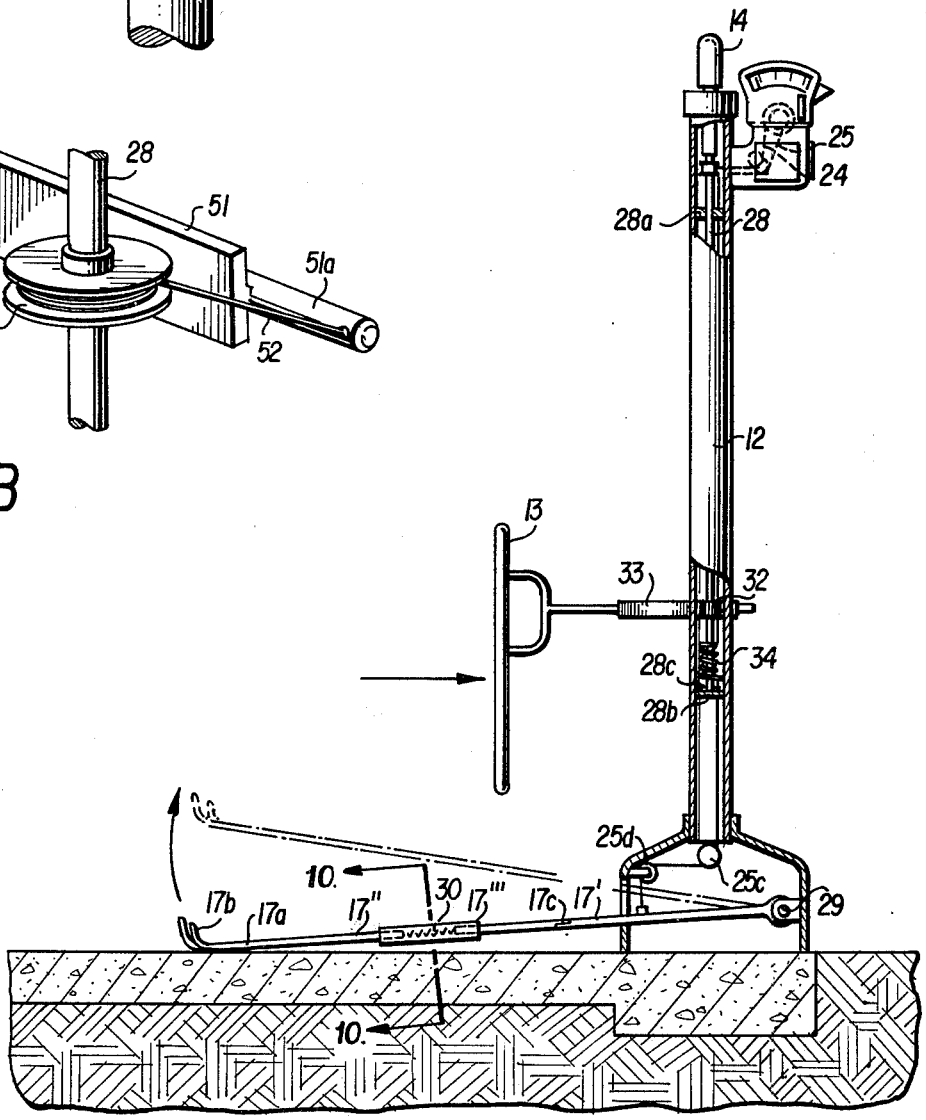
FIG. 2 is a side view, partly in cross-section, of the parking meter, the post on which it is mounted, the vehicle engaging arm and the bumper.

A first elongated flexible substantially inextensible cable 24 and a second elongated flexible substantially inextensible cable 25 are shown in FIGS. 2 and 3A. With particular reference to FIG. 3A, one end of the first cable 24 is connected to the first pulley 18 and one end of the second cable 25 is connected to the second pulley 19.

As shown particularly in FIG. 3A, the first cable 24 extends downwardly from its connection to the first pulley 18 and partially around a guide pulley **24*a* and terminates at its other end which is connected to a third pulley 26. The third pulley 26 is rigidly connected to a substantially vertically extending shaft 28 rotatably mounted within the post 12 by means of bearings 28*a*, 28*b* and is prevented from moving axially downward, as in FIG. 2, by means of a lock washer 28*c* which is fixedly connected to the shaft 28 and which abuts the upper side of the bearing 28b**.

As shown in FIGS. 2 and 3A, the second cable 25 extends downwardly from its connection at one end to the second pulley 19, partially around a guide pulley **25*a* into the post 12 through an aperture therein, partially around a guide pulley 25*b* and downwardly within the post 12, partially around a guide pulley 25*c*, to and partially around a guide pulley 25*c*, and terminates at its other end which is connected to the arm 17**.

One end of the arm 17 is pivotally connected at 29 to the lower end portion of the post 12 and extends outwardly from the post 12 through an aperture therein.

As shown in FIG. 2, the arm 17 includes a substantially horizontally extending portion 17*a* which extends from the pivotal connection at 29 outwardly into the parking area A into a region beneath the underpanel of the parked automobile 10 (FIG. 1). The arm 17 further includes a plurality of substantially vertically extending short finger portions 17*b* which extend upwardly from the free end of the arm portion 17*a*.

The outer free end of the substantially rigid arm 17, including the finger portions 17*b*, is preferably covered with a soft, flexible rubber or plastic. This covering functions to prevent the arm 17 from scratching or seriously damaging any portion of a vehicle to be parked which the arm may contact.

The arm 17 in its upper position, as shown in FIG. 1, functions to engage a portion of the underpanel of the vehicle 10 to thereby prevent removal of the vehicle from parking position adjacent the post 12. In the FIG. 1 position of the arm 17, the finger-like portions 17*b* may not be actually abutting a rearwardly facing portion of the underpanel. However, the portions 17*b* will be in a position to abut a rearwardly facing portion of the chassis, front axle or bumper, etc. of the vehicle if that vehicle is moved away from the post 12. Upon such movement the portions 17*b* will abut and hold a portion of the underpanel and the vehicle. By this means, the arm 17 effectively prevents removal of the vehicle from parking position adjacent the post 12.

The arm 17 is jointed at 17*c* (FIG. 9) so that the portion thereof to the left, when viewed as in FIGS. 2 and 10, of the joint 17*c* is freely upwardly pivotable about the joint relative to the portion thereof to the right of the joint. As shown in FIG. 2, the arm 17 is formed into first, second, and third sections 17′, 17″, and 17‴ respectively. As shown in FIG. 10, the third section 17‴is hollow and has a spring 30 disposed therein. One end of the first section 17′ is telescopically received in and secured to one end of the third sectiion 17‴. Likewise one end of the second section 17″ is telescopically received in and moveable in the other end of the third section 17‴. A stop means may be provided to prevent the second section 17″ from being completely removed from the third section 17‴. If the second arm section 17″ is struck by a plow or other surface cleaning equipment or a vehicle moving into position adjacent the post 12, the second arm section 17″ can move relative to and toward the first arm section 17′ to thereby prevent damage to the arm 17, its connection to the post 12, and any vehicle or cleaning equipment, etc. striking it.

Because the arm 17 is positionable above the surface of the parking area, equipment for cleaning the parking area as well as plows for removing any ice or snow therefrom can move under and around the arm 17 without interfering with it so that potential damage to the arm 17, its connection to the post 12, and related parts of the parking device as well as any cleaning equipment, snow plows, etc. is avoided. Furthermore, by reason of the joint 17*c*, the portion of the arm 17 to the left of the joint 17*c* as viewed in FIG. 2 can freely pivot upwardly away from any such equipment should it come into contact with the portion of the arm to left of the joint 17*c* as viewed in FIG. 2 so as to thereby further avoid the possibility of such interference and damage. Likewise, because the arm section 17″ can move relative to and toward the arm section 17′ such poossible damage is further prevented.

As shown if FIGS. 2, 5, 6 and 8A, a pinion 32 is rigidly connected to the shaft 28. Extending through the post 12 is a rack 33 which is adapted to mesh with the pinion 32 on the shaft 28. The bumper 13 is rigidly connected to the rack 33. The rack 33 is guided for movement through the post 12 by the provision of a guideway in the form of a groove in the post 12 (FIG. 5). The rack 33 has an axially extending projection 33a thereon which rides in and is guided by the guideway formed in the post 12. Upon movement of the rack 33 to the right, as viewed in FIG. 2, the pinion 32 and the shaft 28 rotate in the direction of the arrow shown in FIG. 6. Likewise, rotation of the pinion 32 and the shaft 28 in a direction counter to that of the arrow shown in FIG. 6 moves the rack 33 and bumper 13 toward the left as viewed in FIG. 2. The movement of the rack 33 to the right, as voewed in FIG. 2, is coused by the bumper 13 being contacted and moved by a bumper of the vehicle 10 moving into parking position adjacent the post 12.

As shown in FIGS. 2 and 7, a return spring 34 is positioned around the shaft 28. One end of the coil spring 34 is fixedly connected to the shaft 28 and the other end thereof is fixedly connected to the post 12. As will subsequently appear, the return spring 34 functions to return the bumper 13, rack 33, pinion 32, and shaft 28 to their original unactuated position when the vehicle 10 is removed from the parking area.

As shown in FIGS. 1, 2 and 3A, the indicator member 14 is mounted over the upper end of the shaft 28. The indicator member 14 is movable between a lower position, as shown in FIGS. 2 and 3A, and an upper position, as shown in FIG. 1. The upper position is intended to indicate to an occupant or driver of the vehicle parked, in parking position adjacent the post 12, that the vehicle has been properly parked. As will subsequently appear, the indicator member 14 moves from its lower position to its upper position upon rotation of the shaft 28 when the bumper 13 has been actuated. As shown in FIG. 3A, the upper end of the post 26 is closed by a cap 12a. The cap 12a has a central aperture 12*b* defined therein. The aperture 12*b* is non-circular in cross-section and is preferably either square or rectangular in cross-section. The lower end 14*a* of the indicator member 14 is shaped in cross-section substantially identical to the crosssection of the aperture 12*b* but is of slightly smaller overall dimensions so tht the lower end 14*a* of the indicator member 14 can be freely positioned through the aperture 12*b* and over the upper end of the shaft 26.

As shown in FIG. 3A, the upper end of the shaft 28 is provided with a plurality of threads 31 wound thereabout. The interior of the lower end of the indicator member 14 is hollow so that the threaded portion of the shaft 28 may be positioned therein. Extending inwardly from the lower end 14*a* of the indicator member 14 is at least one projection or key 14*b* which is positionable in the threads 31 on the upper end of the shaft 28. Therefore, upon rotation of the shaft 28 in the direction shown by the arrow in FIG. 3A, the key 14*b* on the lower portion 14*a* of the indicator member 14 rides upwardly along the threads 31 in the upper end of the shaft 28 to thereby move the indicator member 14 upwardly into the position into which it indicates to an occupant or driver of the vehicle 10 that the vehicle has been properly parked in parking position adjacent the post 12.

It is contemplated in this invention that a sign could be positioned adjacent the indicator member 14. The sign may have a mark, such as line, thereon which corresponds to the upper position of the indicator member 14. The sign may carry a statement which in effect tells an occupant of the vehicle that it is properly parked, in parking position adjacent the post 12, when the indicator member is at the level of the mark.

The details of the parking meter 16 will not be described here. Rather only the essential elements thereof necessary for an understanding of this invention will be described. Such parking meters are known per se. Suffice it to say that a mechanical or electrical switch can be provided between the parking meter 16 and the first pulley 18. Upon initial counter-clockwise rotation of the pulley 18 about the shaft 20, the switch is actuated to start the timer on the parking meter 16. Furthermore, after parking for a given period of time, a sufficient monetary amount must be inserted into the parking member 16 through coin slots 36.

Figure 3B:
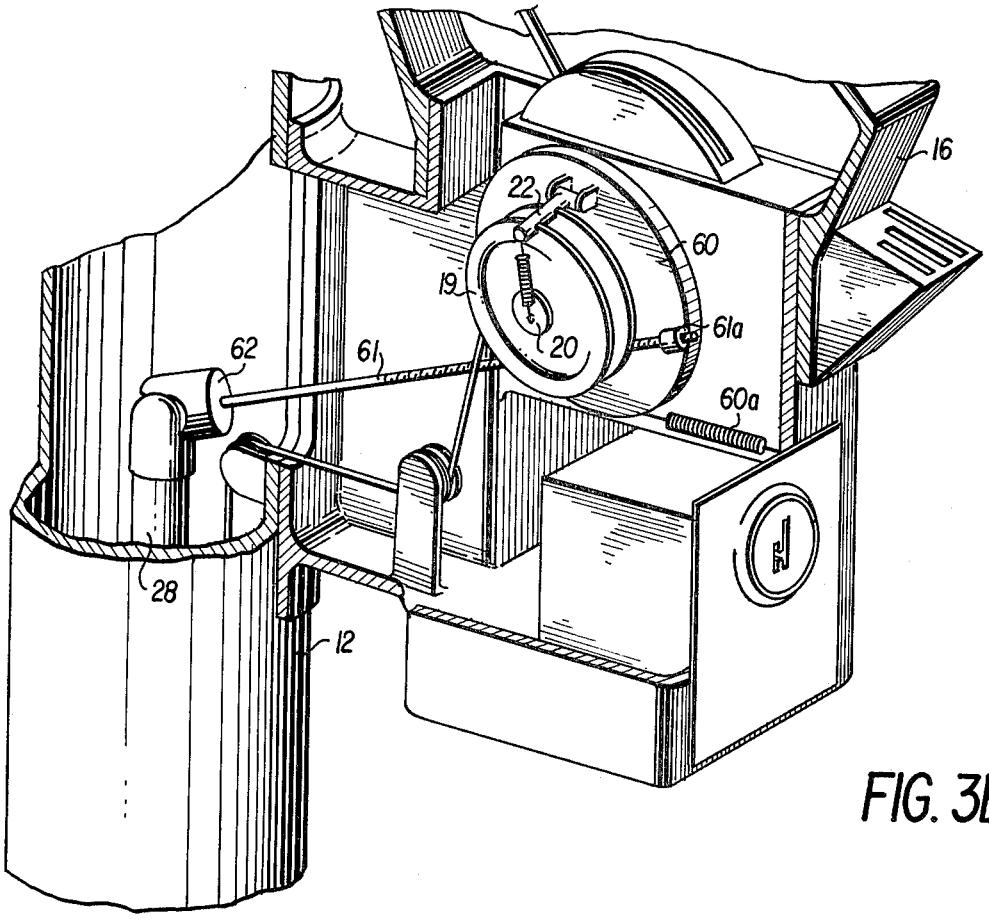
FIG. 3B is a view similar to FIG. 3A but showing an alternative embodiment of the invention.

Upon insertion of the necessary amount, a handle 37 on the parking meter 16 is permitted to rotate about the axis of a pin 38 from its position shown in FIG. 4A to the position shown in FIG. 4B. Rotation of the handle 37 likewise affects rotation of a hammer 39 connected thereto. This rotation of the handle 37 likewise deactuates the timer and returns the timer switch to its deactuated or off position. Upon rotation as shown in FIG. 4B, the hammer 39 also strikes the free end of the arm 22 and moves it out of the notch 21 in the pulley 19. With the arm 22 out of the notch 21, the weight of the arm 17 outwardly of its pivotal connection at 19 to the post 12 causes the arm 17 to fall to its downwardly extending position shown in solid lines in FIG. 2. As the arm 17 falls, it pulls the portion of the cable 25 connected thereto downwardly and thereby rotates the pulley 19 in a clockwise direction as shown in FIG. 4B so that the pulley 19 thereby returns to its intial position as shown in FIG. 3.

With the arm 17 in its lower position in which it may not engage the underpanel of a parked vehicle, the motorist can then remove the vehicle from parking position adjacent the post 12. Upon such removal, the bumper 13, rack 33, pinion 32, shaft 28 and indicator member 14 are returned to their initial position by reason of the action of the return spring 34 returning the shaft 28 to its initial state. Upon this returning movement, the end of the cable 24 is free to move toward the right as viewed in FIG. 3A, By reason of the return spring 18*a* connected to pulley 18, that pulley returns to its initial FIG. 3A position and the portion of the cable 24 adjacent the first pulley 18 is moved upwardly and partially wound about the pulley 18. Upon return of the first pulley 18 to its initial position, the arm 22 moving therewith, when it reaches the uppermost position shown in FIG. 3A, falls back into the notches 21 on the periphery of the second pulley 19 by reason of the biasing action of the spring 22a.

The operation of the above-described embodiment of the invention will now be fully described. Initially, the arm 17 is in its lowermost solid line position, as shown in FIG. 2, in which it will not engage the underpanel of a vehicle moving into or out of parking adjacent the post 12. When a vehicle to be parked enters the parking area A, the bumper of the vehicle contacts and moves the bumper 13 to the right as viewed in FIGS. 1 and 2. This movement of the bumper 13, toward the right as shown in FIG. 2, moves the rack 33 likewise to the right. Movement of the rack 33 rotates the pinion 32 and the shaft 28 in the direction shown by the arrow in FIG. 6. This movement effects a winding of the return spring 34. As described above, and as shown in FIG. 2, this rotation of the shaft 28 in the direction shown by the arrow in FIG. 6 likewise causes the indicator member 14 to move from its lower position shown in FIGS. 2 and 3A to its upper position shown in FIG. 1. As noted above, the upper position indicates to the occupant or driver of the parked vehicle that the vehicle is properly parked. This upward movement of the indicator member 14 is effected by the upward movement of the key 14*b* on the lower portion 14*a* of the indicator member 14 in the threaded portion 31 of the upper end of the shaft 28. The indicator member 14 is prevented from rotating with the shaft 28 by reason of the non-circular cross-section of the lower portion 14*a* of the indicator member 14 together with the similar cross-section of the aperture 12*b* in the cap 12*a* on top of the post 12.

The rotation of the shaft 28 effects a partial winding of the first cable 24 around the third pulley 26 and a partial unwidning of the first cable 24 from the first pulley 18. This unwinding of the cable 24 from the first pulley cause a counterclockwise rotation of substantially 180° of the first pulley 18 connected to the cable 24 and stretches the return spring 18*a*. Furthermore, the second pulley 19, by reason of its being releasably connected with the first pulley 18 through the arm 22, causes a similar substantially 180° counter-clockwise rotation of the second pulley 19. The rotation causes a partial winding of the second cable 25 around the second pulley 19 which thus pulls the portion of that cable connected to the arm 17 and the arm 17 upwardly into its position in which it may engage the underpanel of the vehicle from parking position adjacent the post 12. The vehicle 10 cannot now be removed from the parking area A without satisfying the parking meter 16. The initial counterclockwise rotation of the first pulley 18 actuates the mechanical or electrical switch between the pulley 18 and the meter 16 to start the meter running.

Upon return of the occupant of the vehicle 10 to the parking area A, he must first insert sufficient coins into the coin slots 36 of the parking meter 16 before the arm 17 will be freed to move to its lower position so that he may exit from the parking area A. As described above, upon insertion of a sufficient monetary amount in the parking meter 16 through the coin slots 36, the handle 37 is permitted to rotate counter-clockwise about the axis 38 to thereby rotate the hammer 39 from its position in FIG. 4A to its FIG. 4B position at which point it contacts and moves the arm 22 out of the notches 21 in the pulley 19 so that the second pulley 19 is then again freely rotatable about the shaft 20. The movement of the hammer 39 likewise deactuates the timer and returns the timer switch to its initial off position. With the arm 22 free of the notches 21, the weight of the arm 17 outwardly of its pivotal connection at 29 to the post 12 causes the arm 17 to pivot downwardly about that connection into its lower position at which it may not engage the underpanel of the parked vehicle so that the vehicle may be removed from parking position adjacent the post 12. The arm 17 likewise pulls the portion of the cable 25 connected thereto downwardly as well as the portion of the cable 25 connected to the second pulley 25 downwardly so that the pulley 25 is rotated through substantially 180° in a clockwise direction back to its initial FIG. 3 position. With the arm 17 in its lower position, the operator may now remove the parked vehicle 10 from the parking area. Upon removal of the parked vehicle 10 from the parking area A, the vehicle bumper moves away from the bumper 13. Therefore, the return spring 34 which was wound upon actuation of the bumper 13, rotates the shaft 28 and pinion 32 in a direction opposite that shown by the arrow in FIG. 6. This rotation of the pinion 32 effects a movement of the rack 33 and bumper 13 to the left as shown in FIG. 2 and returns them to their initial unactuated position. Likewise, as described and as shown in FIG. 2, the rotation of the shaft 28 in a direction counter to that shown in FIG. 6, causes the key 14*b* on the lower portion 14*a* of the indicator member 14 to move downwardly along the threads 31 on the upper end of the shaft 28 and thereby moves the indicator member 14 from its upper position back to its lower initial position. This movement takes some of the tension out of the cable 24 and frees it for movement to the right as viewed in FIG. 3A so that the tension of the return spring 18*a*, connected between the first pulley and the parking meter 16, returns that pulley to its initial position shown in FIG. 3 at which time the arm 22 falls back into the notches 21 in the second pulley 19. The parking device has then completed one full cycle of operation and is ready for another vehicle to be parked thereadjacent.

Figure 8B:
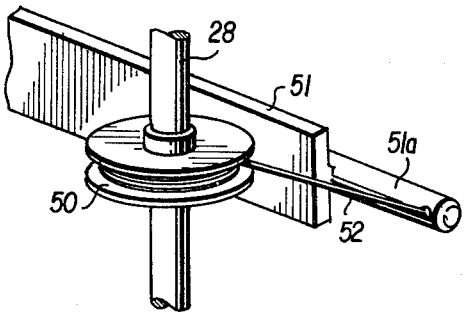
FIG. 8B is a view similar to FIG. 8A but showing an alternative embodiment of the invention.

It is also contemplated in this invention that a bar 51 and a pulley 50 interconnected by a third elongated substantially inextensible flexible cable 52 could be used in place of the rack 33 and pinion 32 described above. The function and movements of the bar 51 and pulley 50 would be substantially identical to those of the rack 33 and pinion 32. Upon initial movement of the bumper 13, when contacted and moved by a vehicle to be parked, to the right, when viewed in FIG. 8B, the bar 51 would move to the right and, by reason of the connection of one end of the cable 52 thereto, would unwind the cable 52 from the pulley 50 and effect a rotation of the pulley 50 and shaft 28 in the direction of the arrow shown in FIG. 9B. Likewise, when the shaft 28 and pulley 50 are rotated, by the action of the return spring 34, in a direction counter to that of the arrow shown in FIG. 8B, the rotation of pulley 50 will cause a partial winding of the cable 52 thereon and a movement of the bar 51, and the bumper 13 connected thereto, to the left as viewed in FIGS. 2 and 9B to return them to their initial unactuated position. The bar 51 is guided, like the rack 33, for movement through the post 12 by a guideway in the form of a groove in the post 12. The bar 51, again like the rack 33, has an axially extending projection 51a thereon which rides in and is guided by the guideway formed in the post 12.

It is also contemplated in this invention that the pulley 18, cable 24, and pulley 26 could be replaced by a disc or plate 60 rotatably mounted on the shaft 20 and a rod 61. One end of the rod 61 is connected by a U-joint 62 to the upper end of the shaft 28 and the other end portion thereof is threaded and is threadingly received in a nut 61*a* pivotably mounted on the periphery of the disc or plate 60. Upon initial movement of the bumper 13, when contacted and moved by a vehicle to be parked, the shaft 28 is rotated as described above. This rotation causes rotation of the rod 61 which causes a nut 61a to move along the rod 61 toward the shaft 28 and move the disc or plate 60 therewith in clockwise direction as viewed in FIG. 3B through approximately 180°. Likewise, upon removal of the parked vehicle from parking position adjacent the post 12, the spring 34 causes the shaft 28 to rotate in a direction opposite to that referred to immediately above. At the same time, a spring 60*a* is urging the disc or plate 60 to rotate counter-clockwise about the shaft 20. Again, the rotation of the shaft 28 imparts rotation to the rod 60 through the U-joint which causes the nut to move along the rod 61 away from the shaft 28 and, with the return spring 60*a*, to move the disc or plate 60 through approximately 180° in a clockwise direction back to its initial unactuated position at which time the arm 22 falls back into the notches 21 in the second pulley 19. The arm 37, hammer 39, timer, etc. would function in this embodiment in the same manner as that described above for the embodiment shown in FIGS. 4A and 4B.

Although the elements 24, 25, and 52 have been described above as cables, it is also contemplated in this invention that these elements may be chains or any other type elongated flexible substantially inextensible line.

It is also contemplated in this invention that a spring could be disposed along portions of cable 25 to divide it into two sections between which the spring is positioned so that if a very low vehicle moved into parking position adjacent the post and the arm 17 engaged the underpanel thereof before the cable 25 was wound about the pulley 19 during its 180° counter-clockwise rotation, the spring could stretch and thereby permit continued winding of the cable 25 on the pulley 19.

Figure 11:
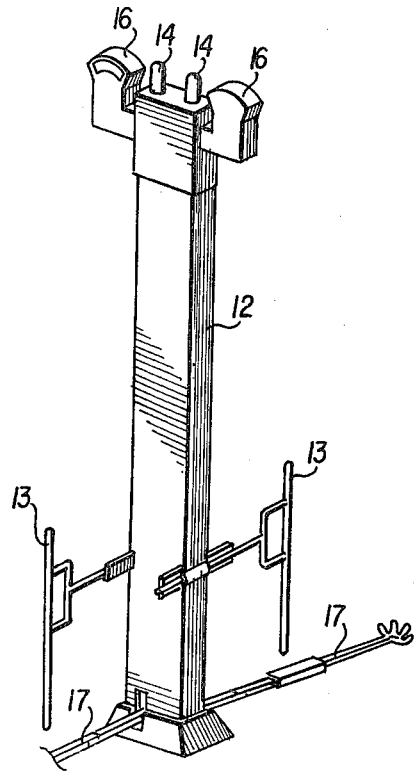
FIG. 11 is a perspective view of a single post having two parking meters, arms, bumpers, and indicator members.

It is also contemplated in this invention that two mutually facing parking areas need only have single post 12 therebetween with the bumpers to be contacted and moved by a vehicle being positioned on opposite sides of the post 12 as shown in FIG. 11. Each bumper 13 would have a respective arm 17, meter 16, and indicator member 14 associated therewith.

We claim:

1. A parking device comprising:

a substantially vertically extending post, a parking meter on said post, means, mounted on said post, for engaging an underpanel of a vehicle parked adjacent said post, said engaging means being movable between a first position in which it can engage the underpanel of a parked vehicle and prevent removal thereof and a second position in which the engaging means cannot engage the underpanel of a vehicle parked adjacent said post so that the vehicle may be moved into or out of parking position adjacent said post, means, mounted on said post, actuable by a vehicle to be parked, operatively connecting said engaging means and said parking meter, said vehicle actuable means, when actuated by a vehicle, actuating said parking meter and moving the engaging means from its second position to its first position, and said parking meter, upon insertion of a sufficient monetary amount therein, being adapted to deactuate said vehicle actuable means so that said engaging means moves from its first position to its second position whereby a parked vehicle may be removed for parking position adjacent said post.

2. A parking device as claimed in claim 1, wherein:

said parking meter is mounted on the upper end of said post.

3. A parking device as claimed in claim 1, wherein: said engaging means comprises an elongated arm pivotally connected to the lower end portion of said post.

4. A parking device as claimed in claim 3, wherein: said arm comprises:
a first elongated substantially horizontally extending arm portion pivotally connected at one end thereof to the post, and
a plurality of substantially vertically extending short finger portions extending upwardly from the other end of the arm portion.

5. A parking device as claimed in claim 4, wherein: the arm portion comprises a joint adjacent said one end thereof about which the part of the arm, from the joint out to and including the finger portions, is upwardly pivotable.

6. A parking device as claimed in claim 3, wherein: said arm extends substantially horizontally and the end portion of said arm most remote from said post is moveable relative to and toward the remainder of the arm so that if the end portion is forced in a direction toward the post, the connection between the arm and the post will not be damaged.

7. A parking device as claimed in claim 3, wherein: said arm extends substantially horizontally and comprises:
a first arm section connected to said post;
a second arm section, and
a third arm section,
said third arm section is hollow and has a cross section larger than that of the first and second arm sections, the end of said first arm section most remote from the post is positioned in one end of the third arm section, and one end of the second arm section is positioned in the other end of said third arm section, and
a spring is positioned in said third arm section between the end of the first arm section and the end of the second arm section so that if the second arm section is forced in a direction toward the post, the second arm section can move relative to and toward the first arm section, and the connection between the first arm section and the post will not be damaged.

8. A parking device as claimed in claim 1, wherein: said vehicle actuable means comprises a bumper adapted to be contacted and moved by a vehicle moving into parking position adjacent said post.

9. The parking device as claimed in claim 8, wherein: said vehicle actuable means further comprises:
a substantially vertically extending shaft rotatably mounted within the post, and
means interconnecting said bumper and said shaft whereby the said bumper is moved, by a vehicle moving into parking position adjacent said post, said shaft is rotated.

10. The parking device as claimed in claim 9, further comprising:
a return spring connected between said post and said bumper to its unactuated position when a parked vehicle moves out of contact therewith.

11. The parking device as claimed in claim 9, wherein:
said interconnecting means comprises:
a pinion mounted on said shaft, and
a rack, adapted to mesh with said pinion, rigidly connected to said bumper.

12. The parking device as cliamed in claim 9, wherein:
said interconnecting means comrpises:
a pulley rigidly mounted on said shaft,
a bar rigidly connected to said bumper, and
a flexible cable, one end of said cable being connected to said bar and the other end thereof being connected to said pulley.

13. A parking device as claimed in claim 3, wherein: said vehicle actuable means comprises:
a shaft on said parking meter,
a first member on said shaft,
a second member on said shaft releasably interconnected to the first member,
an actuator member adapted to be contacted and moved by a vehicle moving into parking position adjacent said post,
a first element, one end portion of said first element being connected to said first member and the other end portion of said first element being connected to said actuator member,
a second elongated flexible element, one end portion of said second element being directly connected to said second member and the other end portion of said second element being directly connected to an intermediate portion of said arm whereby when said vehicle actuable means is initially actuated by a vehicle moving into parking position adjacent said post, said actuator member is moved by the vehicle and said first element connected to said actuator member is also moved which thereby moves said first member, and second member releasably connected thereto, said second element, and said arm from its second to its first position.

14. A parking meter as claimed in claim 13, wherein: said vehicle actuable means further comprises:
a substantially vertically extending shaft rotatably mounted within the post,
a third member fixedly mounted on the upper end portion of said vertically extending shaft so as to be rotatable therewith,
means interconnecting said actuator member and said vertically extending shaft whereby when said actuator member is moved, by a vehicle moving into parking position adjacent said post, said vertically extending shaft is rotated, and
the first element is an elongated flexible element and the one end portion of said first element is directly connected to said first member and the other end portion of the first element is directly connected to said third member.

15. A parking device as claimed in claim 14, wherein:
said first element is a cable,
said second element is a cable,
said first member is a pulley,
said second member is a pulley, and
said third member is a pulley,
a return spring connected between said first pulley and said parking meter,
means defining a notch in the periphery of said second pulley,
a spring biased arm pivotally connected to said first pulley, and
said spring biased arm is releasably positionable in said notch to thereby releasably connect said first and second pulleys.

16. A parking meter is claimed in claim 13, wherein:

said vehicle actuable means further comprises:

a substantially vertically extending shaft rotatably mounted within the post, means interconnecting said actuator member and said vertically extending shaft whereby when said actuator member is moved, by a vehicle moving into parking position adjacent said post, said vertically extending shaft is rotated, and the first element comprises a rod connected at one end by a U-joint to the upper end of the vertically extending shaft and pivotally connected at its other end to said first member.

17. A parking device as claimed in claim 16, wherein:

said second element is a cable, said second member is a pulley, a return spring connected between said first member and said parking meter, means defining a notch in the periphery of the second pulley, a spring biased arm pivotally connected to said first member, and said spring biased arm is releasably positionable in said notch to thereby releasably connect said first and second members.

18. A parking device as claimed in claim 1, wherein:

said vehicle actuable means comprises:

an actuator member adapted to be contacted and moved by a vehicle moving into parking position adjacent said post, a substantially vertically extending shaft rotatably mounted within said post, and means interconnecting said actuator member and said shaft whereby when said actuator member is moved, by a vehicle moving into parking position adjacent said post, said shaft is rotated, and an indicator member connected to the upper end of said shaft, said indicator member being movable between a first lower position and a second upper position indicating a vehicle is properly parked.

19. A parking device as claimed in claim 19, wherein:

the upper end of said shaft is threaded, and said indicator member is substantially nonrotatable, is mounted over the upper end of the shaft, and comprises a key which extends into the threads on said shaft whereby when said actuator member is moved, by a vehicle moving into parking position adjacent said post, said shaft is rotated and said key moves upwardly along the threads in said shaft and elevates said indicator member from its first position to its second position.

20. A parking device comprising:

a substantially vertically extending post, a parking meter on the upper end of said post, a substantially horizontally extending arm, pivotally connected to the lower end portion of said post, for engaging an underpanel of a vehicle parked adjacent said post, said arm being movable between a first position in which it can engage the underpanel of a parked vehicle and prevent removal thereof and a second position in which the arm cannot engage the underpanel of a vehicle parked adjacent said post so that the vehicle may be moved into or out of parking position adjacent said post, means actuable by a vehicle to be parked, operatively connecting said arm and said parking meter, said vehicle actuable means, when actuated by a vehicle, actuating said parking meter and moving the arm from its second position to its first position, said vehicle actuable means comprising a bumper, adapted to be contacted and moved by a vehicle moving into parking position adjacent said post, mounted on an intermediate portion of said post, and said parking meter, upon the insertion of a sufficient monetary amount therein, being adapted to deactuate said vehicle actuable means so that said arm moves from its first position to its second position whereby a parked vehicle may be removed from its parking position adjacent said post.

21. A parking device as claimed in claim 20, wherein:

said arm comprises:

a first elongated substantially horizontally extending arm portion pivotally connected at one end thereof to the post, and a plurality of substantially vertically extending short finger portions extending upwardly from the other end of the arm portion.

* * * * *